US008035304B2

(12) United States Patent
Selezneva et al.

(10) Patent No.: US 8,035,304 B2
(45) Date of Patent: Oct. 11, 2011

(54) CERAMIC HIGH INTENSITY DISCHARGE LAMP HAVING UNIQUELY SHAPED SHOULDER

(75) Inventors: Svetlana Selezneva, Schenectady, NY (US); Mohamed Rahmane, Clifton Park, NY (US); Sairam Sundaram, Guilderland, NY (US); Andrey Meshkov, Niskayuna, NY (US); Garry R. Allen, Chesterland, OH (US); Viktor Varga, Solon, OH (US); Agoston Boroczki, Budapest (HU)

(73) Assignee: General Electric Company, Niskayuna, NY (US)

( * ) Notice: Subject to any disclaimer, the term of this patent is extended or adjusted under 35 U.S.C. 154(b) by 520 days.

(21) Appl. No.: 12/043,459

(22) Filed: Mar. 6, 2008

(65) Prior Publication Data

US 2009/0224674 A1 Sep. 10, 2009

(51) Int. Cl.
*H01J 17/18* (2006.01)
*H01J 61/36* (2006.01)

(52) U.S. Cl. ..... 313/623; 313/493; 313/573; 313/620; 313/634; 313/639

(58) Field of Classification Search ..... None
See application file for complete search history.

(56) References Cited

U.S. PATENT DOCUMENTS

| | | | | |
|---|---|---|---|---|
| 2,121,638 | A * | 6/1938 | Lemmers | 313/42 |
| 2,405,089 | A * | 7/1946 | Craig | 313/631 |
| 3,937,996 | A * | 2/1976 | Cap | 313/631 |
| 4,065,691 | A * | 12/1977 | McVey | 313/565 |
| 4,808,876 | A * | 2/1989 | French et al. | 313/25 |
| 4,949,003 | A * | 8/1990 | Cox et al. | 313/25 |
| 4,983,889 | A | 1/1991 | Roberts | |
| 5,047,695 | A | 9/1991 | Allen et al. | |
| 5,198,727 | A | 3/1993 | Allen et al. | |
| 5,258,691 | A | 11/1993 | Dakin et al. | |
| 5,416,383 | A * | 5/1995 | Genz | 313/634 |
| 5,997,162 | A | 12/1999 | English et al. | |
| 6,043,614 | A | 3/2000 | Tessnow et al. | |
| 6,215,254 | B1 | 4/2001 | Honda et al. | |
| 6,404,129 | B1 | 6/2002 | Hendricx et al. | |
| 6,791,267 | B2 | 9/2004 | Niimi | |
| 2004/0108814 | A1 | 6/2004 | Tsuda et al. | |
| 2004/0174121 | A1 | 9/2004 | Tsuda et al. | |
| 2005/0007020 | A1 | 1/2005 | Tsuda et al. | |

FOREIGN PATENT DOCUMENTS

| | | |
|---|---|---|
| EP | 1158567 | 11/2001 |
| EP | 1172839 | 1/2002 |
| EP | 1363313 | 11/2003 |
| WO | WO2004023517 | 3/2004 |
| WO | WO2004051700 | 6/2004 |

* cited by examiner

*Primary Examiner* — Ashok Patel
(74) *Attorney, Agent, or Firm* — Fletcher Yoder

(57) ABSTRACT

A high intensity discharge lamp, in certain embodiments, includes a uniquely shaped shoulder and dimensions selected to reduce stress and associated cracking. The uniquely shaped shoulder has a variable diameter, such as, e.g., a cup-shaped geometry, a curved funnel-shaped geometry, or a conical-shaped geometry. The selected or optimized dimensions may include a tip-to-neck distance, a tip-to-wall distance, and an internal diameter of the lamp. The selected or optimized dimensions also may include a uniform wall thickness, an arc gap distance, and an electrode thickness. These dimensions and shapes are selected to reduce undesirably high maximum stresses and temperatures in the lamp. As a result, the lamp is able to provide higher performance with a longer life due to a decreased risk of stress cracking during rapid start up and steady state operation.

30 Claims, 9 Drawing Sheets

CERAMIC HIGH INTENSITY DISCHARGE LAMP HAVING UNIQUELY SHAPED SHOULDER

BACKGROUND

The invention relates generally to lamps and, more particularly, techniques to reduce the potential for thermal stresses and cracking in ceramic high-intensity discharge (HID) lamps.

High-intensity discharge lamps are often susceptible to crack formation and failure due to various stresses within the lamp. In certain applications, such as automotive, it is desirable to provide a quick start of the lamp. Unfortunately, this quick start subjects the lamp to severe thermal shock. For example, the quick start causes a rapid increase in temperature and hot spots within the lamp. In turn, the rapid temperature changes and hot spots (i.e., temperature differentials) often lead to the formation of cracks in the lamp. These cracks can reduce the performance of the lamp, and eventually lead to lamp failure. In addition, the liquid dose often penetrates into these cracks and further deteriorates the lamp performance and limits its life. For example, the liquid dose may be corrosive to the material (e.g., metal) in the vicinity of the cracks. These temperature differentials can have more significant effects on lamps with poorly designed geometries, interfaces, and so forth. For example, compressive or tensile stresses can develop in certain geometries and interfaces. Unfortunately, existing lamps often have geometries and/or interfaces that abruptly change, e.g., step from one diameter to another, along a length of the lamp. As a result, the severe thermal shock associated with a quick start of the lamp can lead to significantly higher stresses, hot spots, and susceptibility to cracking in the vicinity of an abrupt change in geometry and/or interfaces.

BRIEF DESCRIPTION

A high intensity discharge lamp, in certain embodiments, includes a uniquely shaped shoulder in the vicinity of the electrode tip in the transition region between the arc chamber and the legs of the arctube, and dimensions selected to reduce stress and associated cracking. The uniquely shaped shoulder has a variable diameter, such as, e.g., a cup-shaped geometry, a curved funnel-shaped geometry, or a conical-shaped geometry. The selected or optimized dimensions may include a tip-to-neck distance, a tip-to-wall distance, and an internal diameter of the lamp. The selected or optimized dimensions also may include a uniform or non-uniform wall thickness, an arc gap distance, and an electrode thickness. These dimensions and shapes are selected to reduce undesirably high maximum stresses and temperatures in the lamp. As a result, the lamp is able to provide higher performance with a longer life due to a decreased risk of stress cracking during rapid start up and steady state operation.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
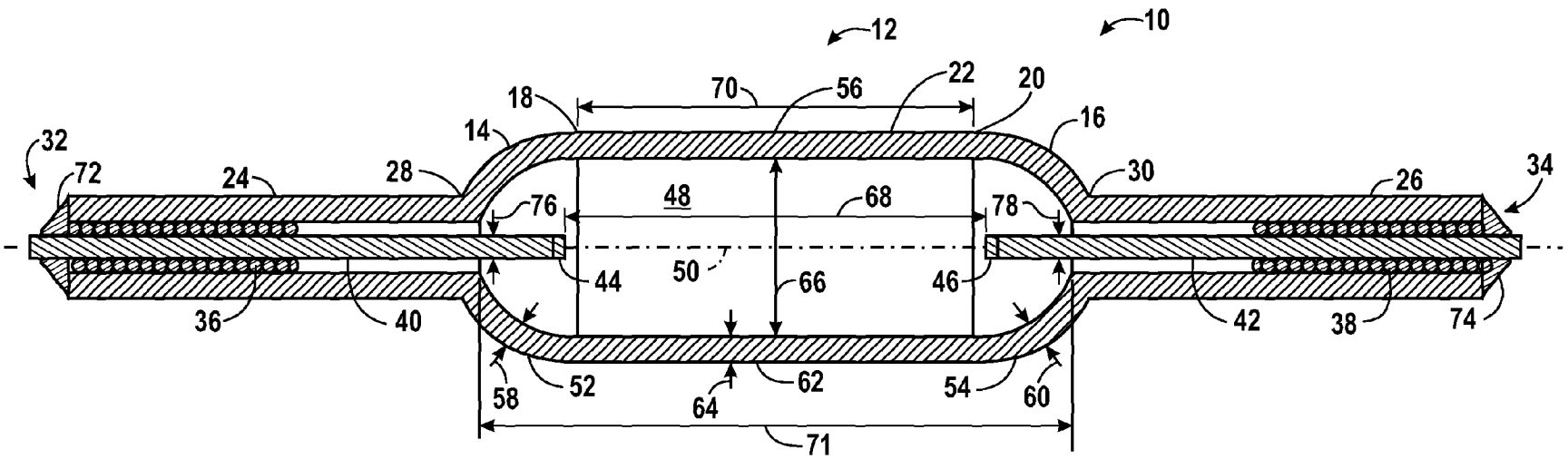
FIG. 1 is a cross-sectional view of an embodiment of a high intensity discharge lamp having a curved shoulder (e.g., a cup-shaped or concave geometry) in the vicinity of an electrode tip.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components. Any examples of dimensions and shapes are not exclusive of other dimensions and shapes. Also, any examples of dimensions and shapes for various portions of an assembly (e.g., HID lamp) are intended to be used alone or in combination with one another.

As discussed in detail below, embodiments of the present technique relate to high intensity discharge (HID) lamps, such as those found, for example, in automotive applications.

However, the lamps discussed below are not limited to any particular application. The disclosed embodiments provide the thermal and structural design space for a horizontally operated lamp, with a transparent or translucent ceramic envelope material, that is suitable as an automotive headlight (20-50 W) or other low watt (20-100 W) HID lamp application. The shape and the dimensions of the arc envelope or arc tube and the positions of the electrodes relative to the arc envelope are specified below, such that the stresses due to thermal shock during the fast start-up of the lamp and to thermal gradients during steady state operation are reduced far below the strength of the ceramic and below the strength of the end-seal structure. Therefore, the high performance of the lamp is not compromised by its reliability and life.

In many applications, such as automotive headlamps, it is desirable to design the lamps specially for quick start, e.g., in 4 seconds after the lamp is switched on it should generate about 80% of its steady state lumen output. As a result, the lamp should be able to withstand a severe thermal shock during the warm-up. In existing lamps, a fast increase of the temperature was observed in the electrode root regions that results in the formations of cracks during the time of warming up. The liquid dose then penetrates inside these cracks and reacts with the metal parts inside the legs, which significantly deteriorates the performance of the lamp and limits its life. The embodiments discussed below address these issues with optimized shapes and dimensions of the lamp.

In designing the ceramic HID lamps discussed in detail below, the following circumstances are considered along with the operating conditions mentioned above. In any high-pressure ceramic HID lamp operating in a substantially horizontal orientation, circumferential tensile stresses develop on the outside part of the arc envelope during the operation because of the significant difference between top and bottom temperatures, which is a result of the discharge arc column bending due to the natural convection. As a result, it was found desirable to minimize the temperature difference between the top and bottom of the lamp to reduce temperature differentials, stresses, and potential crack formation. In general, an isothermal arc envelope is desirable for achieving long life. Moreover, it was found desirable to limit the compressive stresses and the temperatures on the inside of the arc envelope. Even though the ceramic material can withstand temperatures up to 1500K, the high compressive stresses at the location of the hottest spot on the inner surface of the arc envelope can result in creep deformation if the operating temperature is too high. As our models and experiments show, at a given power and for a given dose composition, the temperature distribution of an HID arc tube is controlled by the shape and the dimensions of the arc envelope, and these parameters can be carefully optimized to improve the lamp performance and increase the lamp life. For instance, it was found that an elliptical shape of the arc envelope operates more isothermally than a straight cylindrical tube of similar dimensions. Furthermore, the elliptical arc envelope enables a larger internal diameter of the lamp while maintaining the desired high temperature in the cooler regions of the arc chamber where the temperature of metal halide condensate determines the vapor pressure of the radiating metals that provide the photometric performance of the lamp. Electrode positioning relative to the arc envelope is also a factor controlling the stress formation in the ceramic. It was found desirable to position the electrode tip sufficiently far both from the arc envelope center and the neck of the arc envelope in order to prevent ceramic overheating and cracking. In addition, it was found that positioning the electrode tips sufficiently far from the bulb internal surface closest point is desirable (i.e., the shortest distance from the electrode tips to the internal surface of the bulb). This applies to lamps having electrodes centered along the axial centerline and, also, lamps having electrodes off-center or shifted from the axial centerline. It should be noted that conventional lamps are not optimized in the manner set forth below. Thus, the disclosed shapes and dimensions are not found in conventional lamps.

As discussed below, in certain embodiments, a ceramic HID automotive lamp has a rated power of 20-50 W, a shape of the arc envelope may or may not include a central cylindrical portion, and the arc envelope has curved shoulders of uniform or non-uniform wall thickness. The shoulders are curved in a way so that the temperature in the wall closest to the electrode tip is not too high and not too low, and the stresses generated both in the center of the arc envelope and in the neck region are essentially below the strength of the ceramic material. Furthermore, metal electrodes are sealed inside the legs of the lamp, and may have an arc gap equal to or greater than 2 mm and equal to or smaller than 8 mm.

In one exemplary embodiment discussed below, the lamp has the following design features. The arc gap is at least equal to or greater than the length of the cylindrical part of the arc envelope, and is at least 4 mm but smaller than 6 mm. The distance from the electrode tip to the arc envelope neck is not too large or too small, e.g., $0.25\ \text{mm} \leqq TN \leqq 1.55\ \text{mm}$. The arc envelope shoulder is curved in such a way so that the distance between the electrode tip and the closest wall point in a vertical direction is equal to or greater than 0.13 mm and smaller than half of the internal diameter (ID) of the lamp, e.g., $0.13\ \text{mm} \leqq TW < ID/2$. The arc envelope internal diameter (ID) is not too small and not too large, e.g., $1.6\ \text{mm} \leqq ID \leqq 4$ mm. If the internal diameter is greater than 2.5 mm, then an arc straightening technique (e.g., magnetic or acoustic straightening) can be used to straighten the bent/curved arc plasma between the electrode tips in a horizontally operated lamp. The wall thickness is inversely related to the internal diameter. For a design with the internal diameter $1.6\ \text{mm} \leqq ID \leqq 2.5$ mm, a suitable arc envelope wall thickness is equal to or larger than 0.6 mm and smaller than 1.2 mm. For a design with $2.5\ \text{mm} < ID \leqq 4$ mm, the wall thickness can be in the range of 0.3-0.8 mm. The diameter of the electrode shank is not too large to guarantee electron emission and not too small to avoid its melting, e.g., 0.25 mm<shank diameter<0.4 mm. Again, the various shapes and dimensions disclosed herein are intended to reduce stresses, reduce hot spots and other temperature differentials, and reduce the growth of cracks in the lamps. As a result, the disclosed embodiments of HID lamps provide relatively greater performance and longevity than existing lamps.

FIG. 1 is a cross-sectional view of an exemplary embodiment of a high intensity discharge (HID) lamp 10 having various geometries and dimensions selected to at least substantially improve or optimize performance of the lamp. As illustrated, the lamp 10 includes a ceramic arc envelope 12 having first and second shoulder portions 14 and 16 extending outwardly from first and second body ends 18 and 20 of a central body portion 22. The lamp 10 also includes first and second legs 24 and 26 extending outwardly from the first and second shoulder portions 14 and 16 at first and second necks 28 and 30, respectively. The lamp 10 further includes first and second electrode assemblies 32 and 34 extending lengthwise through the first and second legs 24 and 26. As illustrated, the first and second electrode assemblies 32 and 34 include wire overwinds or coils 36 and 38 disposed concentrically about shanks 40 and 42. The first and second electrode assemblies 32 and 34 also include electrode tips 44 and 46 disposed on inner peripheral portions of the shanks 40 and 42, such that the electrode tips 44 and 46 are disposed within a hollow interior 48 of the ceramic arc envelope 12. As discussed in further detail below, each of these components may be made from a variety of materials with shapes and dimensions selected to at least substantially improve or optimize performance of the lamp 10, while also minimizing stresses, potential for crack growth, and hot spots within the lamp 10.

In certain embodiments, the ceramic arc envelope 12, which includes the shoulder portions 14 and 16 and the body portion 22, may be made from a variety of light-transmitting ceramics and other materials, such as polycrystalline alumina (PCA) or yttrium-aluminum-garnet (YAG). Other embodiments of the arc envelope 12 may be made from ytterbium-aluminum-garnet, microgram polycrystalline alumina (μPCA or MCA), AlN, sapphire or single crystal alumina, yttria, spinel, and ytterbia. The foregoing materials provide relatively low light absorption, high temperature capability, high strength, corrosion resistance and other desired characteristics.

In addition, the shoulder portions 14 and 16 of the ceramic arc envelope 12 may be shaped and dimensioned to reduce stresses, reduce temperature differentials (e.g., more isothermal temperature distribution), and reduce the potential for crack formation within the lamp 10. For example, the shoulder portions 14 and 16 have diameters or widths that vary relative to a longitudinal axis 50 of the lamp 10 between the respective necks 28 and 30 and body ends 18 and 20. In the illustrated embodiment, the shoulder portions 14 and 16 have a curved shaped, such as a cup-shaped geometry, a concave geometry, an elliptical geometry, or an egg-shaped or S-shaped geometry. As a result, the illustrated shoulder portions 14 and 16 gradually decrease in diameter from the body ends 18 and 20 along the longitudinal axis 50 toward the respective necks 28 and 30. The shoulder portions 14 and 16 are curved in a way so that the temperature in a wall 52 and 54 closest to the electrode tips 44 and 46 is not too high and not too low, and so that the stresses generated both in a center 56 of the arc envelope 12 and in the necks 28 and 30 are essentially below the strength of the ceramic material. The walls 52 and 54 in the shoulder portions 14 and 16 also have uniform or non-uniform thicknesses 58 and 60. Similarly, the body portion 22 of the arc envelope 12 has a cylindrical wall 62 disposed about the hollow interior 48, and the wall 62 has a uniform thickness 64.

Regarding optimization of the lamp 10, the wall thicknesses 58, 60, and 64 are inversely related to an internal diameter 66 of the central body portion 22. Based on various testing and optimization, a suitable dimension of the wall thicknesses 58, 60, and 64 may range between about 0.6 mm and 1.2 mm for a design with the internal diameter 66 ranging between 1.6 mm and 2.5 mm. For a design with the internal diameter 66 between about 2.5 mm and 4 mm, a suitable dimension for the wall thicknesses 58, 60, and 64 may range between about 0.3 mm and 0.8 mm.

Thus, based on various testing and design optimization, the illustrated arc envelope 12 may have the internal diameter 66 in a range between about 1.6 mm and 4 mm, which is not too small and not too large to cause undesirably high stresses and non-uniformity in the temperature distribution. If the internal diameter 66 of the illustrated horizontally operated arc envelope 12 is greater than about 2.5 mm, then the arc plasma between the electrode tips 44 and 46 can bend or curve beyond an acceptable limit within a horizontally oriented lamp 10. For example, undesirably high bending of the arc plasma can cause high temperature differentials (e.g., hot spots), high stresses, and a resulting formation of cracks in the lamp 10. Accordingly, one or more arc straightening techniques, such as magnetic or acoustic straightening, may be applied to the lamp 10 to straighten the bending arc plasma between the electrode tips 44 and 46 or just shift the arc center line downwards and thus reducing the "effective" bending value.

Furthermore, based on various testing and design optimization, an arc gap 68 between the electrode tips 44 and 46 is at least greater than or equal to a length 70 of the central body portion 22, e.g., between the ends 18 and 20 where the shoulder portions 14 and 16 extend toward the necks 28 and 30. The arc gap 68 is also less than an internal bulb length (IBL) 71, e.g., the distance between the interior portions of the necks 28 and 30 where the diameters begin changing from the legs 24 and 26 to the shoulder portions 14 and 16. For example, in certain embodiments, the illustrated arc gap 68 may range between about 2 mm and 8 mm. By further example, in certain embodiments, the illustrated arc gap 68 may range between about 4 mm and 6 mm.

The illustrated legs 24 and 26 may be an integral part of or coupled to the arc envelope 12. For example, in the illustrated embodiment, the arc envelope 12 and the legs 24 and 26 are a single piece structure, which may be formed of a single material (e.g., ceramic) in a single process without coupling together various separate components. In other words, the one-piece structure including the arc envelope 12 and the legs 24 and 26 may be free of seal interfaces between the various components. As a result, the arc envelope 12 and the integral legs 24 and 26 may be integrally made of a suitable ceramic, such as PCA, YAG, or another suitable ceramic as discussed in detail above with reference to the arc envelope 12. Alternately, the configuration of the one-piece structure can be achieved by joining two separately formed halves of the structure at some point between the ends 18 and 20, for example at or near the center 56. Again, these halves may be made of the same material, e.g., ceramic.

In alternative embodiments, the legs 24 and 26 may be made from different materials than the arc envelope 12. For example, the legs 24 and 26 may be made from a different ceramic, a cermet, a metal, or a combination thereof. Furthermore, the legs 24 and 26 may be coupled to the arc envelope 12 at the respective necks 28 and 30 via diffusion bonding without a seal material, with a seal material such as a sealing glass, with a plurality of sealing materials having progressively changing coefficients of thermal expansion, or another suitable sealing technique. In one specific embodiment, the legs 24 and 26 may be made from a ductile metal or alloy, such as molybdenum, rhenium, molybdenum-rhenium alloy, or a combination thereof. For example, an exemplary molybdenum-rhenium alloy has about 35-55% by weight of rhenium. In certain embodiments, the molybdenum-rhenium alloy has about 44-48% by weight of rhenium. In such embodiments with different materials and separate components, the legs 24 and 26 may be coupled to the arc envelope 12 by a crimping and/or a focused heating technique. For example, a laser, an induction heating coil, or another suitable technique, may be used to focus heat in the desired seal region without requiring the entire lamp 10 to be placed inside a furnace.

The illustrated electrode assemblies 32 and 34 are configured to reduce stresses and improve the seal with the legs 24 and 26, such that the lamp 10 can operate over a broader range of power input, internal pressures, and temperatures without forming cracks in the legs 24 and 26. For example, the coils 36 and 38 may be made from a ductile metal to provide resiliency or flexibility in the seal between the shanks 40 and 42 and the legs 24 and 26. For example, the coils 36 and 38 may be made from molybdenum, rhenium, molybdenum-rhenium alloy, or a combination thereof. Thus, the ductile material and the partial freedom to move provided by the coils 36 and 38 is able to absorb at least some of the stresses between the electrode assemblies 32 and 34 and the legs 24 and 26. As a result, the possibility of stress cracks developing within the legs 24 and 26 is substantially reduced by these electrode assemblies 32 and 34. The shanks 40 and 42 also may be made from a variety of materials, such as tungsten, or doped tungsten, or a tungsten alloy. In addition, the material of the coils 36 and 38 and/or the shanks 40 and 42 may be made entirely of or coated with a corrosion resistant material, such as molybdenum, to reduce the possibility of corrosion by a dosing material disposed within the hollow interior 48 of the lamp 10. The electrode tips 44 and 46 also may be made from a variety of materials, such as tungsten, molybdenum, rhenium, or a combination thereof, or with additional dopants. Furthermore, the electrode tips 44 and 46 may include coils or other configurations suitable for high intensity discharge electrode tips.

As appreciated, the electrode assemblies 32 and 34 may be inserted lengthwise into the legs 24 and 26 along the longitudinal axis 50, such that precise control of the arc gap 68 can be achieved during the assembly of the lamp 10. For example, if the legs 24 and 26 are made of a ductile material, then the legs 24 and 26 may be crimped and laser welded about the electrode assemblies 32 and 34. However, if the legs 24 and 26 are made of a non-ductile metal or ceramic, then the electrode assemblies 32 and 34 may be sealed or co-sintered within the legs 24 and 26 via focused heating or placement of the entire lamp 10 within a furnace. In either case, the ductile material and/or the partial freedom to move provided by the coils 36 and 38 absorbs various stresses within the legs 24 and 26 during operation of the lamp 10. As illustrated in the embodiment of FIG. 1, the legs 24 and 26 and the respective coils 36 and 38 and shanks 40 and 42 may be sealed to one another at welds 72 and 74. Again, the illustrated welds 72 and 74 may be achieved via spot welding, laser welding, induction heating, and so forth.

Various features of the electrode assemblies 32 and 34 also may be optimized for the illustrated lamp 10. For example, the shanks 40 and 42 have diameters or thicknesses 76 and 78, which are selected to be sufficiently small to guarantee electron emission and sufficiently large to avoid melting or excessive evaporation or sputtering loss of the shanks 40 and 42. In certain embodiments, based on various testing and design optimization, the diameters 76 and 78 of the shanks 40 and 42 may be in a range of about 0.25 mm to about 0.4 mm. Again, as discussed above, the arc gap 68 also may be selected to optimize performance, reduce stresses, improve temperature uniformity, and reduce the potential for cracking within the lamp 10. For example, the arc gap 68 of the illustrated lamp 10 is selected to be greater than or equal to the length 70 of the central body portion 22. In the specific embodiment discussed herein, the arc gap 68 may be in a range of about 4 mm to about 6 mm. Furthermore, as discussed in further detail below with reference to FIG. 2, the distances between the electrode tips 44 and 46 and inner surfaces of the ceramic arc envelope 12 may be selected to optimize lamp performance, minimize stresses, improve uniformity in a temperature distribution, and reduce the potential for cracking within the lamp 10.

In the illustrated embodiment, the electrode assemblies 32 and 34 (including the electrode tips 44 and 46) are generally aligned along the longitudinal axis 50 (e.g., centerline). However, in alternative embodiments, the electrode assemblies 32 and 34 may be mounted at positions off-axis or generally offset from the longitudinal axis 50 of the lamp 10. For example, the legs 24 and 26 may be positioned off-axis or generally offset from the longitudinal axis 50, such that the electrode assemblies 32 and 34 are also off-axis when mounted within the respective legs 24 and 26. By further example, the shanks 40 and 42 may bend at an angle or curve away from the longitudinal axis 50 toward the respective electrode tips 44 and 46, such that the tips 44 and 46 are off-axis or generally offset from the longitudinal axis 50. In this manner, the off-axis positions of the tips 44 and 46 may improve the performance of the lamp 10 by centering the arc within the body portion 22 of the arc envelope 12. In other words, depending on the radius of the arc between the tips 44 and 46, the tips 44 and 46 may be offset from the axis 50 to generally center the arc about the axis 50.

Figure 2:
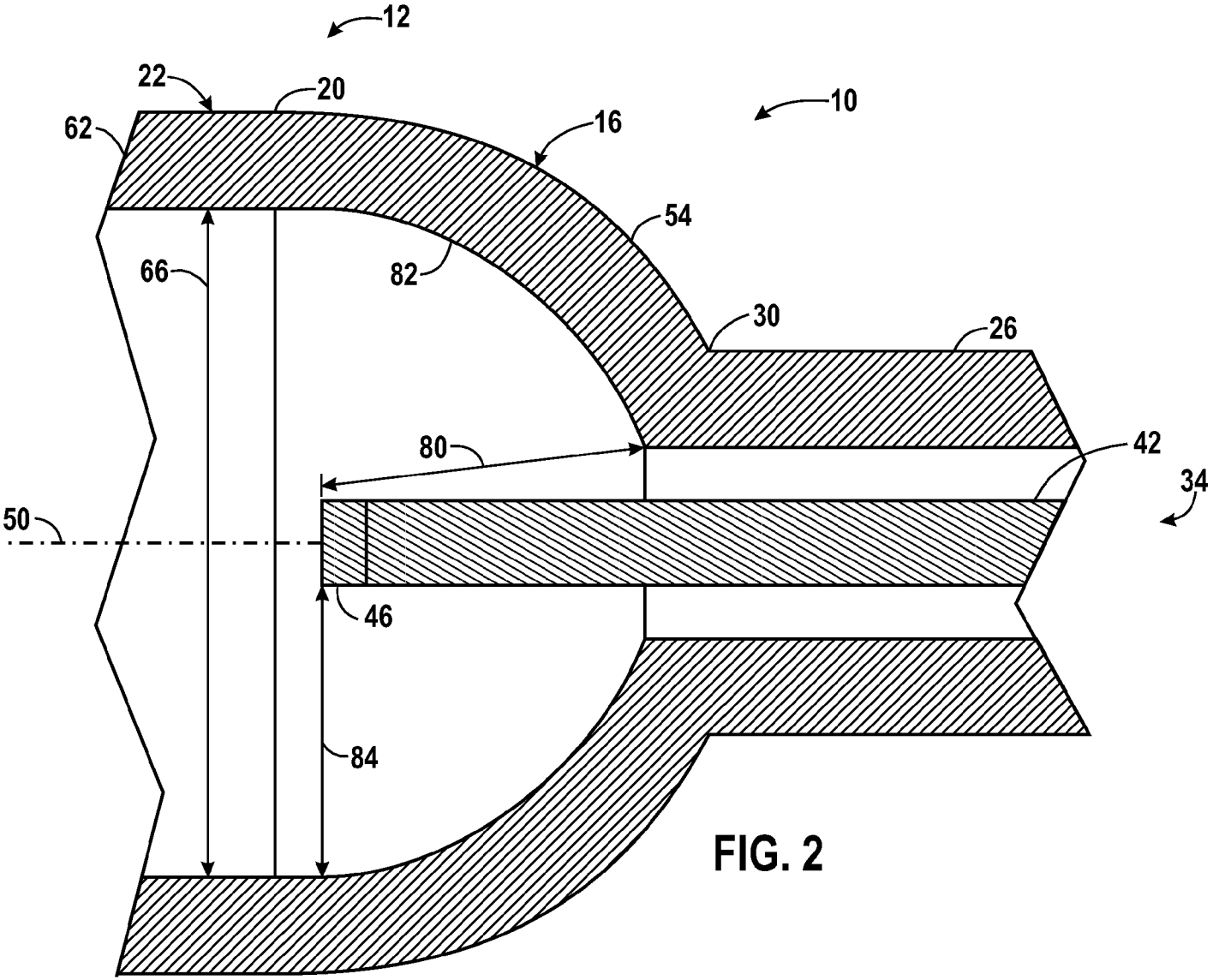
FIG. 2 is a partial cross-sectional view of the high intensity discharge lamp as illustrated in FIG. 1, further illustrating geometrical features of the curved shoulder in the vicinity of the electrode tip.

FIG. 2 is a partial cross-sectional view of the lamp 10 as illustrated in FIG. 1, further illustrating a portion of the shoulder portion 16, the neck 30, the leg 26, and the shank 42 of the electrode assembly 34. As illustrated, the location of the electrode tip 46 is optimized based on one or more dimensions relative to the shoulder portion 16. Specifically, a tip-to-neck (TN) distance 80 is defined as the distance between the electrode tip 46 and an inner surface 82 of the shoulder portion 16 at the neck 30 or junction between the shoulder 16 and the leg 26. Furthermore, a tip-to-wall (TW) distance 84 is defined as the distance between the electrode tip 46 and the inner surface 82 of the shoulder portion 16 in a direction perpendicular to the longitudinal axis 50 and the wall 62 of the central body portion 22. These distances 80 and 84 are selected to be not too small and not too large, such that the temperature in the wall closest to the electrode tip 46 is not too high and not too low and the stresses generated in the center 56 of the arc envelope 12 and the neck 30 are below the strength of the ceramic material.

In certain embodiments, the tip-to-neck distance 80 is in a range of about 0.25 mm to about 1.55 mm. Similarly, the tip-to-wall distance 84 is in a range of about 0.13 mm to about one half of the internal diameter 66 (i.e., the internal radius) of the arc envelope 12. Thus, in the present embodiment, given that the internal diameter 66 is in a range of about 1.6 mm to 4 mm, the tip-to-wall distance 84 is in a range of about 0.13 mm to about 0.8 mm-2 mm depending on the selected internal diameter 66. In this particular embodiment, one or both of these distances 80 and 84 may be used to characterize and optimize the location of the electrode tip 46 within the lamp 10. In the same manner, these distances 80 and 84 may be used to optimize and characterize the location of the electrode tip 44 on the opposite end of the lamp 10. In the illustrated embodiment, the distance 80 is generally identical for both of the electrode tips 44 and 46, and the distance 84 is generally identical for both of the electrode tips 44 and 46. However, certain embodiments may employ different dimensions at the different ends and electrode tips 44 and 46 in the lamp 10.

As illustrated in FIGS. 1 and 2, the inner surface 82 of the shoulder 16, and likewise the shoulder 14, has a curved geometry that may be characterized as a cup shape, a concave geometry, an elliptical geometry, or an egg shape. The inner surface 82 gradually increases in diameter from the neck 30 toward the body end 20. More specifically, the diameter of the inner surface 82 more rapidly expands or increases in the vicinity of the neck 30 as compared to the body end 20. The shoulder portion 14 also has an identical or similar geometry as the shoulder 16. This variable diameter geometry substantially reduces stress and hot spots in the necks 28 and 30 as compared to a straight cylindrical arc envelope that abruptly leads to legs (i.e., abruptly changes from one diameter to another).

Figure 3:
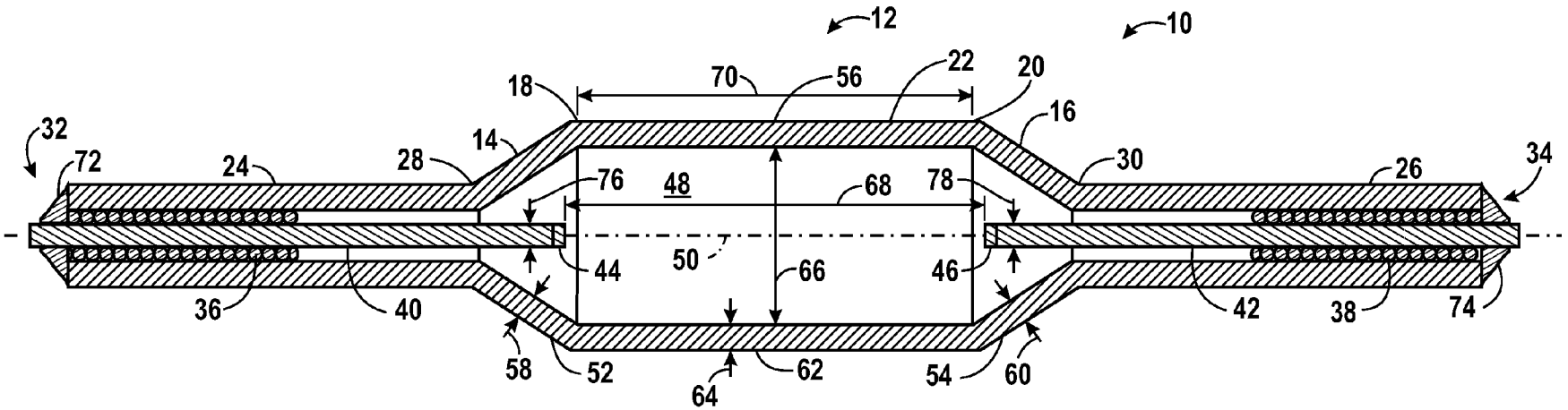
FIG. 3 is a cross-sectional view of an alternative embodiment of the high intensity discharge lamp as illustrated in FIGS. 1-2, further illustrating a conical-shaped shoulder in the vicinity of an electrode tip.

FIG. 3 is a cross-sectional view of an alternative embodiment of the lamp 10 as illustrated in FIG. 1, further illustrating an alternative geometry of the shoulder portions 14 and 16 of the arc envelope 12. In the illustrated embodiment, the shoulder portions 14 and 16 have a conical shape rather than a curved shape. In other words, the diameter of the shoulder portions 14 and 16 changes in a linear manner along the longitudinal axis 50 from the necks 28 and 30 toward the respective body ends 18 and 20. However, like the curved geometry of FIGS. 1-2, the changing diameters in the shoulder portions 14 and 16 are configured to at least substantially improve or optimize performance, reduce stresses, improve temperature uniformity, and reduce the possibility of stress cracks within the lamp 10. Again, the tip-to-neck distance 80 and the tip-to-wall distance 84 may be used to optimize the location of the electrode tips 44 and 45 relative to the interior of the shoulder portions 14 and 16 and the necks 28 and 30. In one embodiment, the illustrated lamp 10 of FIG. 3 has all of the dimensional ranges discussed above with reference to the embodiment of FIGS. 1-2.

Figure 4:
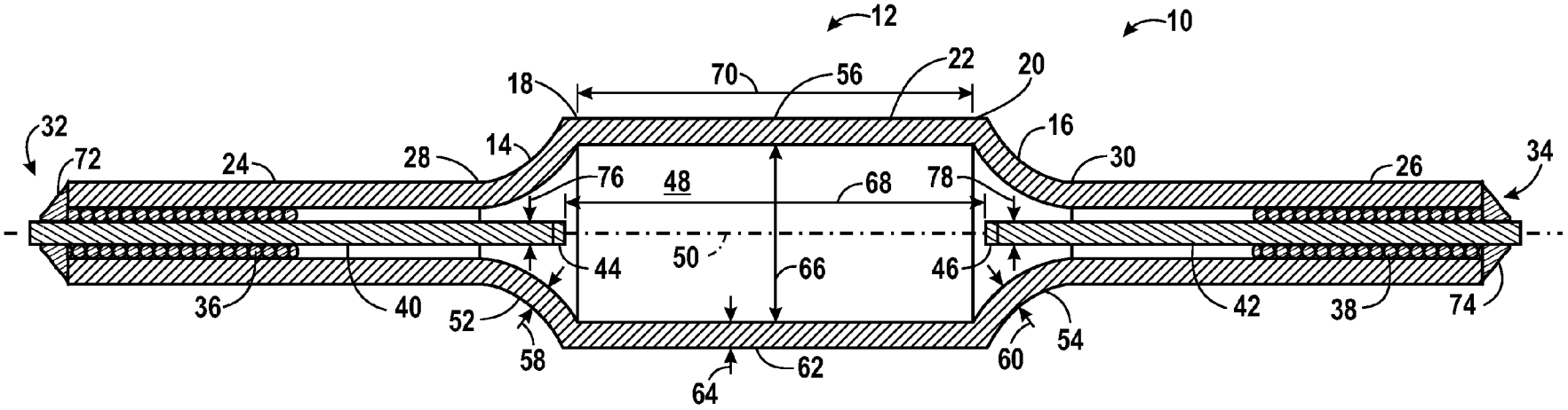
FIG. 4 is a cross-sectional view of an alternative embodiment of the high intensity discharge lamp as illustrated in FIGS. 1-2, further illustrating an inversely curved shoulder (e.g., a curved funnel-shaped geometry) in the vicinity of an electrode tip.

FIG. 4 is a cross-sectional view of another alternative embodiment of the lamp 10 as illustrated in FIGS. 1 and 2, illustrating another curved geometry of the shoulder portions 14 and 16. In the illustrated embodiment, the shoulder portions 14 and 16 have a curved shape that is essentially inverse to the curved shape illustrated in FIGS. 1 and 2. In other words, the shape of the shoulder portions 14 and 16 may be characterized as a curved funnel shape, a convex shape, or generally an annular curved shape that increases in diameter more slowly in the vicinity of the necks 28 and 30 and more rapidly in the vicinity of the body ends 18 and 20. Again, similar to the other embodiments discussed above, the tip-to-neck distance 80 and the tip-to-wall distance 84 may be used to optimize the location of the electrode tips 44 and 46 relative to the shoulder portions 14 and 16, the necks 28 and 30, and other portions of the lamp 10. In one embodiment, the illustrated lamp 10 of FIG. 4 has all of the dimensional ranges discussed above with reference to the embodiment of FIGS. 1-2.

In the illustrated embodiments of FIGS. 1-4, the shoulder portions 14 and 16 generally have the same geometry at both ends of the body portion 22, and the geometry is generally one type of geometry (e.g., conical, or concave, or convex). In alternative embodiments, the shoulder portion 14 may have a different geometry than the shoulder portion 16. For example, the shoulder portion 14 may have a conical geometry as shown in FIG. 3, whereas the shoulder portion 16 may have a concave or convex geometry as shown in FIGS. 1 and 4, or vice versa. By further example, the shoulder portion 14 may have a curved geometry as shown in FIG. 1, whereas the shoulder portion 16 may have a curved geometry as shown in FIG. 4, or vice versa.

In other embodiments, one or both of the shoulder portions 14 and 16 may include a complex geometry including variations of a particular geometry, e.g., varying angles of the conical geometry (FIG. 3), varying radii of the curved geometry (FIG. 1 or 4), and so forth. For example, with reference to the conical geometry of the portions 14 and 16 in FIG. 3, an alternative embodiment may include a first conical section, a second conical section, a third conical section, a fourth conical section, and so forth, wherein each conical section has a different angle relative to the axis 50 (e.g., 75, 55, 35, and 15 degrees). By further example, with reference to the curved geometry of the portions 14 and 16 in FIGS. 1 or 4, an alternative embodiment may include a first curved section, a second curved section, a third curved section, a fourth curved section, and so forth, wherein each section includes a different radius of curvature.

Furthermore, in some embodiments, one or both of the shoulder portions 14 and 16 may include a complex or multi-type geometry, such as a combination of two or more of the geometries shown in FIGS. 1, 3, and 4. For example, the shoulder portions 14 and 16 may include a conical geometry (FIG. 3) followed by a curved geometry (FIG. 1), or vice versa. By further example, the shoulder portions 14 and 16 may include a conical geometry (FIG. 3) followed by a curved geometry (FIG. 4), or vice versa. By further example, the shoulder portions 14 and 16 may include a curved geometry (FIG. 1) followed by a curved geometry (FIG. 4), or vice versa. This particular configuration may be referred to as an S-shaped geometry, as discussed below with reference to FIG. 5. By further example, the shoulder portions 14 and 16 may include a series of geometries, such as a curved geometry (FIG. 1), a conical geometry (FIG. 3), and a curved geometry (FIG. 4), or vice versa. By further example, the shoulder portions 14 and 16 may include a series of geometries, such as a conical geometry (FIG. 3), a curved geometry (FIG. 1), and a curved geometry (FIG. 4), or vice versa. By further example, the shoulder portions 14 and 16 may include a series of geometries, such as a conical geometry (FIG. 3), a curved geometry (FIG. 4), and a curved geometry (FIG. 1), or vice versa.

Figure 5:
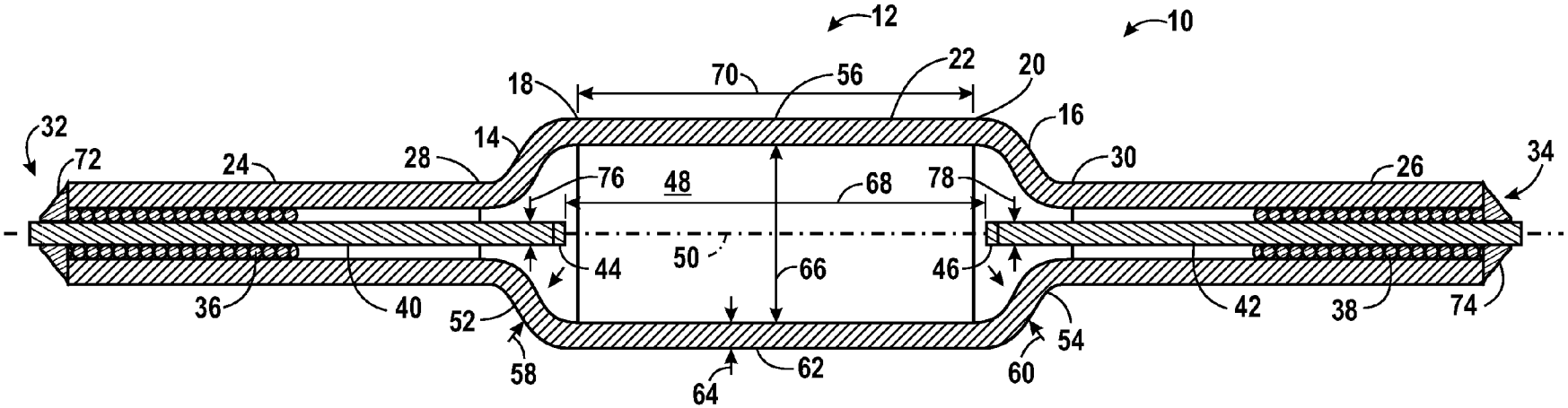
FIG. 5 is a cross-sectional view of an alternative embodiment of the high intensity discharge lamp as illustrated in FIGS. 1-2, further illustrating a multi-curved shoulder (e.g., S-shaped geometry) in the vicinity of an electrode tip.

FIG. 5 is a cross-sectional view of an alternative embodiment of the high intensity discharge lamp 10 as illustrated in FIGS. 1-2, further illustrating a multi-curved geometry (e.g., S-shaped geometry) of the shoulder portions 14 and 16. In the illustrated embodiment, the shoulder portions 14 and 16 have two different curved shapes, e.g., the cup shape of FIG. 1 in the vicinity of the body ends 18 and 20 and the curved funnel shape in the vicinity of the necks 28 and 30. Thus, the shoulder portions 14 and 16 curve outwardly relative to the axis 50 in the vicinity of the necks 28 and 30, and curve inwardly relative to the axis 50 in the vicinity of the body ends 18 and 20. In other words, in the vicinity of the necks 28 and 30, the shape of the shoulder portions 14 and 16 may be characterized as a curved funnel shape, a convex shape, or generally an annular curved shape that increases in diameter more slowly in the vicinity of the necks 28 and 30 and more rapidly in an intermediate region between the necks 28 and 30 and the body ends 18 and 20. In the vicinity of the body ends 18 and 20, the shape of the shoulder portions 14 and 16 may be characterized as a cup shape, a concave geometry, an elliptical geometry, an egg shape, or generally an annular curved shape that increases in diameter more slowly in the vicinity of the body ends 18 and 20 and more rapidly in an intermediate region between the necks 28 and 30 and the body ends 18 and 20. Again, similar to the other embodiments discussed above, the tip-to-neck distance 80 and the tip-to-wall distance 84 may be used to optimize the location of the electrode tips 44 and 46 relative to the shoulder portions 14 and 16, the necks 28 and 30, and other portions of the lamp 10. In one embodiment, the illustrated lamp 10 of FIG. 5 has all of the dimensional ranges discussed above with reference to the embodiment of FIGS. 1-2.

Figure 6A:
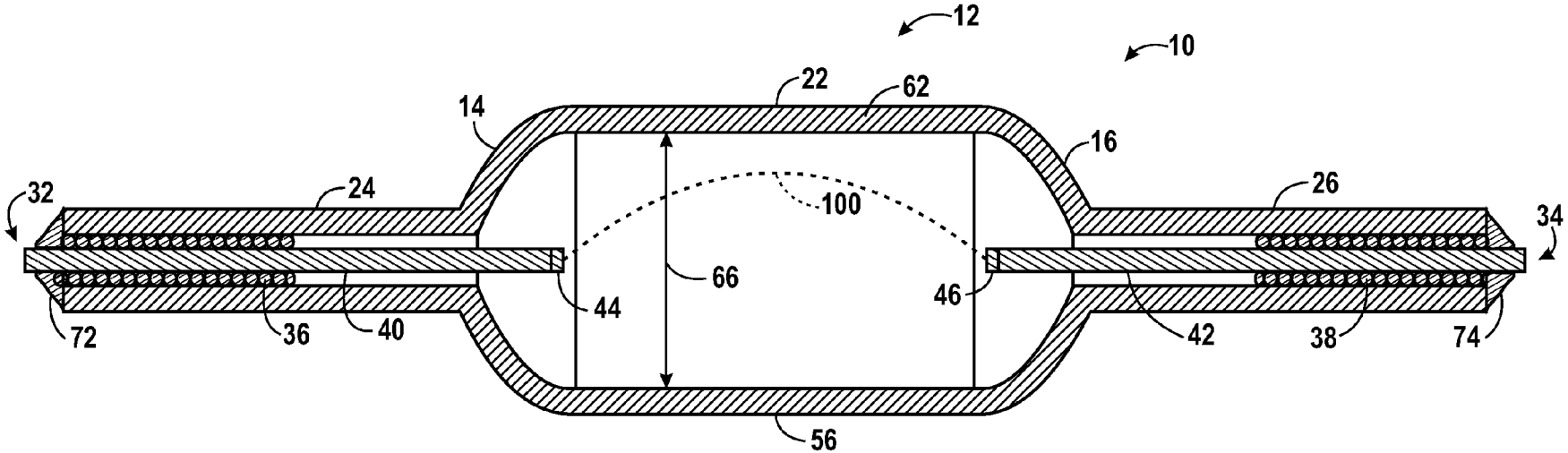
FIG. 6A is a cross-sectional view of another embodiment of the high intensity discharge lamp as illustrated in FIGS. 1-2, further illustrating a curved arc at least partially attributed to an increase in the internal diameter of the lamp.
Figure 6B:
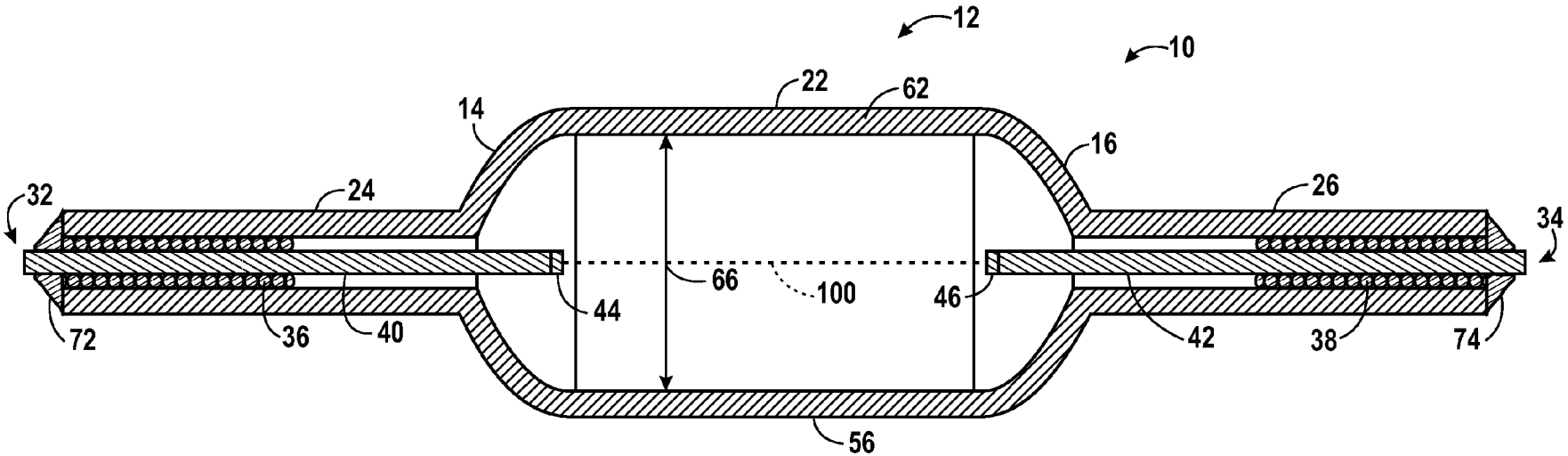
FIG. 6B is a cross-sectional view of the high intensity discharge lamp as illustrated in FIG. 6A, further illustrating a modified position of the arc resulting from an arc straightening technique that substantially reduces or eliminates the curvature in the arc shown in FIG. 6A.

FIGS. 6A and 6B illustrate an alternative embodiment of the lamp 10 as illustrated in FIGS. 1 and 2, wherein the features of the lamp 10 are generally the same with the exception of a larger internal diameter 66 of the central body portion 22 of the arc envelope 12. As illustrated, an arc discharge or plasma 100 extends between the electrode tips 44 and 46 within the arc envelope 12. As mentioned above, it was observed that the arc plasma 100 bends or curves with increasing magnitude as the internal diameter 66 increases in the illustrated lamp 10. For example, if the internal diameter 66 is greater than about 2.5 mm in the illustrated lamp 10, the arc plasma 100 bends to a significant magnitude that can cause undesirably high stresses, temperature differentials, hot spots, and resulting stress cracks within the lamp 10.

For example, as illustrated in FIG. 6A, the arc plasma 100 is relatively close to the wall 62 of the central body portion 22 in the vicinity of the center 56. As a result, the temperature differential and stresses at the center 56 of the body portion 22 may cause significant damage and eventual failure of the lamp 10. Therefore, it may be desirable to maintain the internal diameter 66 between about 1.6 mm and 2.5 mm to reduce the possibility of significant bending of the arc plasma 100. However, in certain applications, it may also be desirable to design the lamp 10 with the internal diameter 66 greater than or equal to 2.5 mm. In such a design, it has been found that arc straightening techniques can be used to straighten the arc plasma 100 as illustrated in FIG. 6B. Accordingly, with arc straightening techniques (e.g., magnetic or acoustic straightening), the lamp 10 may be designed with the internal diameter 66 at least up to about 4 mm. Accordingly, depending on whether or not arc straightening techniques are used, the lamp 10 may be designed with the internal diameter 66 in a range of about 1.6 mm to about 4 mm as discussed above. However, despite the advantages of these arc straightening techniques, the lamp 10 may be designed without arc straightening techniques and still have the internal diameter 66 in the range of 1.6 mm to about 4 mm.

Figure 7:
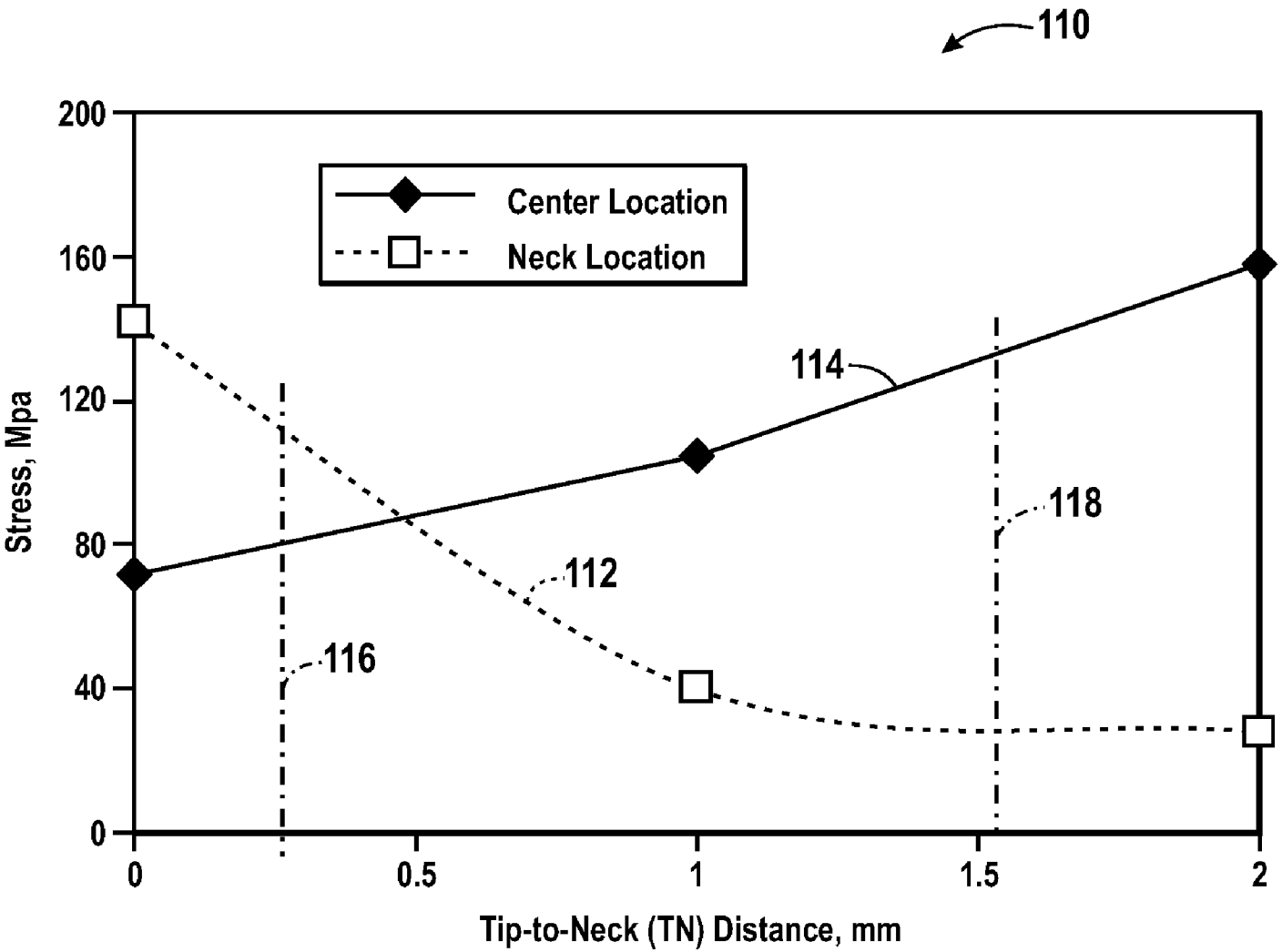
FIG. 7 is a graph of steady-state stress versus tip-to-neck distance for an embodiment of the high intensity discharge lamp, for example, as illustrated in FIGS. 1-2.

FIG. 7 is a graph 110 of steady-state stress versus tip-to-neck (TN) distance for an embodiment of the high intensity discharge lamp 10 as illustrated in FIGS. 1 and 2. As discussed in detail above, the tip-to-neck distance (TN) may be defined as the distance between the electrode tips 44 and 46 and the corresponding necks 28 and 30 in the vicinity or junction between the shoulder portions 14 and 16 and their corresponding legs 24 and 26. As illustrated in FIG. 2, the tip-to-neck distance is labeled as distance 80. As illustrated in FIG. 7, the stress is shown in MPa in two locations, namely, a center location and a neck location. The center location corresponds to the center 56 as shown in FIG. 1, while the neck location corresponds to the first neck 28 or the second neck 30 as shown in FIG. 1. Specifically, dashed line 112 illustrates the response of the stress at the neck location, and generally decreases from about 140 MPa to about 40 MPa in the range of 0 to 2 mm tip-to-neck distance. Conversely, solid line 114 illustrates the response of the stress at the center location, and indicates an increase in the stress from about 70 MPa to about 170 MPa in the range of 0 to 2 mm tip-to-neck distance. Thus, embodiments of the present lamp 10 are designed with a tip-to-neck distance that limits the stress in the various regions of the lamp 10, such as the neck location and the center location. As illustrated in FIG. 7, lower and upper limits 116 and 118 are selected for the tip-to-neck distance, such that the stresses in both the neck and center locations are maintained below critical levels. For example, as discussed above, the lower and upper limits 116 and 118 may be in a range of about 0.25 mm to about 1.6 mm.

Figure 8:
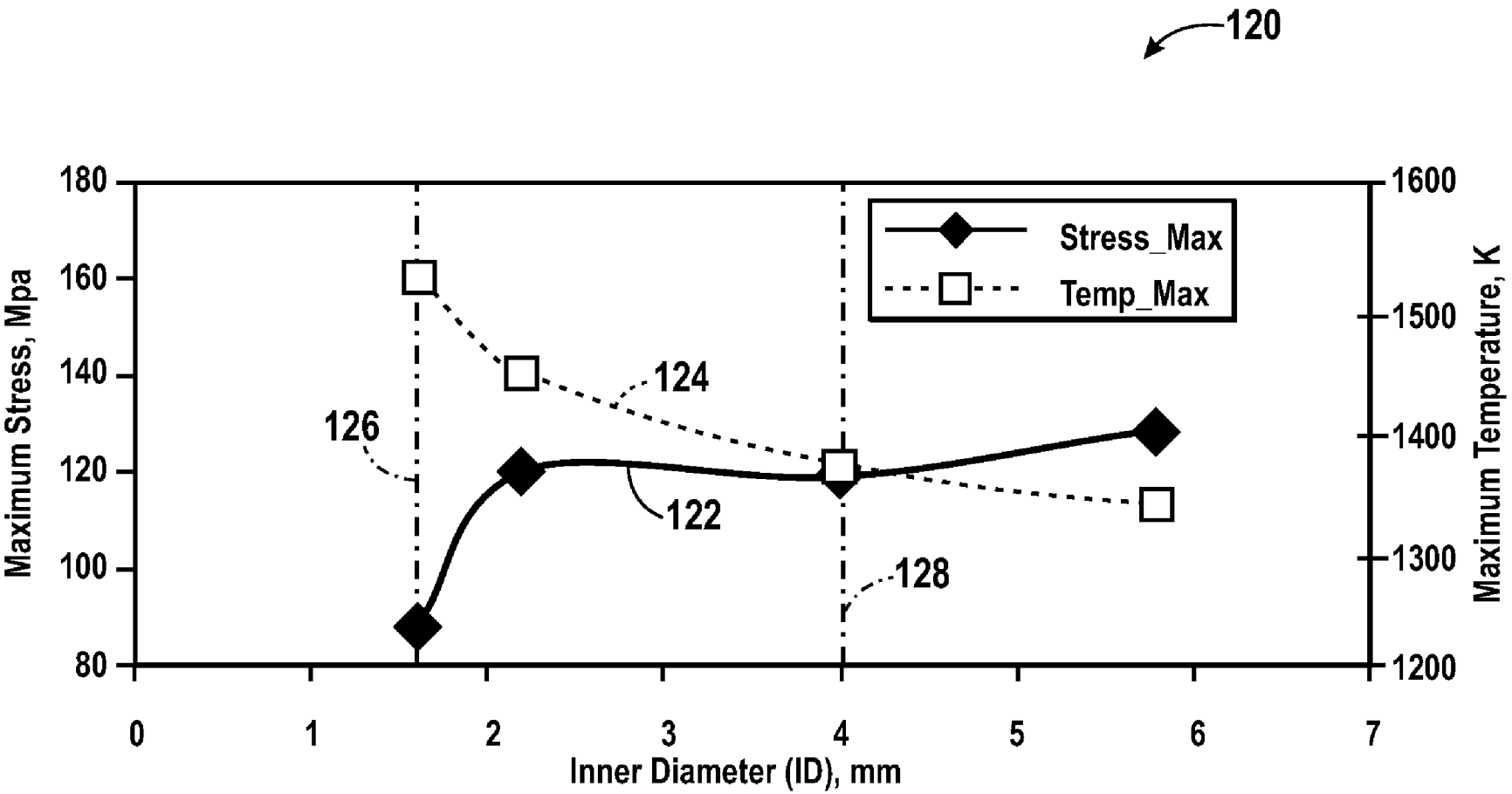
FIG. 8 is a graph of maximum steady-state stress and temperature versus internal diameter for an embodiment of the high intensity discharge lamp, for example, as illustrated in FIGS. 1-2

FIG. 8 is a graph 120 of maximum steady-state stress and maximum temperature versus the internal diameter (ID) of an embodiment of the high intensity discharge lamp 10 as illustrated in FIGS. 1 and 2. The internal diameter corresponds to the diameter 66 inside the central body portion 22 of the arc envelope 12 as shown in FIG. 1. The maximum stress is shown in MPa and the temperature is shown in degrees Kelvin. As illustrated in FIG. 8, solid line 122 illustrates the response of the maximum stress within the lamp 10 as a function of the internal diameter from about 1.5 mm to about 6 mm. Specifically, the solid line 122 illustrates a general increase in the maximum stress corresponding to an increase in the internal diameter 66 of the lamp 10. Conversely, dashed line 124 illustrates the response of the maximum temperature as a function of the internal diameter 66 in a range of about 1.5 mm to about 6 mm. Specifically, the dashed line 124 illustrates a general decrease in the maximum temperature corresponding to an increase in the internal diameter 66 of the lamp 10.

As a result, the maximum stress and the maximum temperature are generally inversely proportional relative to one another as functions of internal diameter. Thus, an optimal design of the lamp 10 generally has an internal diameter 66 that limits both the maximum stress and the maximum temperature within the lamp 10. In the illustrated embodiment of FIG. 1, as discussed in detail above, the internal diameter 66 may have a lower limit 126 and an upper limit 128 as indicated by dashed vertical lines in FIG. 8. These limits 126 and 128 may correspond to a range of about 1.6 mm to about 4 mm internal diameter 66. In this manner, the maximum stress and the maximum temperature within the lamp 10 are maintained within acceptable limits to reduce the possibility of stress cracking within the lamp 10. If the internal diameter 66 is larger than a certain diameter (e.g., 4 mm), then the design may result in an undesirably low bulb temperature for a particular power range (e.g., 20 W-100 W), thereby reducing performance of the lamp 10.

In certain embodiments of the lamps 10 discussed above, the lamp 10 may have a variety of different lamp configurations and types, such as a high intensity discharge (HID) or an ultra high intensity discharge (UHID) lamp. For example, certain embodiments of the lamp 10 comprise a high-pressure sodium (HPS) lamp, a ceramic metal halide (CMH) lamp, a short arc lamp, an ultra high pressure (UHP) lamp, or a projector lamp. Thus, the lamp 10 may be part of a video projector, a vehicle headlight, or a street light, among other things. As mentioned above, the lamp 10 is uniquely shaped and dimensioned to accommodate relatively extreme operating conditions. Externally, some embodiments of the lamp 10 are capable of operating in a vacuum, nitrogen, air, or various other gases and environments. Internally, some embodiments of the lamp 10 retain pressures exceeding 20, 100, 200, 300, or 400 bars and temperatures exceeding 1000, 1300, 1400 or 1500 degrees Kelvin. For example, certain configurations of the lamp 10 operate at internal pressure of 400 bars and an internal temperature at or above the dew point of mercury at 400 bars, i.e., approximately 1400 degrees Kelvin. Different embodiments of the lamp 10 also hermetically retain the variety of dosing materials, such as a rare gas and mercury. In some embodiments, the dosing material comprises a halide (e.g., bromine, iodine, etc.) or a rare earth metal halide. Certain embodiments of the dosing material also include a buffer gas, such as xenon, krypton, or argon gas. In other embodiments, the lamp 10 is mercury free. For example, the lamp 10 may be dosed with a rare gas (e.g., Xe), metal halides, and zinc or zinc iodide.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a high intensity discharge lamp, comprising:

a ceramic arc envelope comprising a central portion and first and second shoulder portions disposed about the central portion, wherein the first and second shoulder portions each have a progressively varying diameter;

first and second legs coupled to the first and second shoulder portions at first and second necks, respectively, wherein the first and second shoulder portions each comprise one or more cup-shaped geometries, or one or more curved funnel-shaped geometries, or one or more conical-shaped geometries, wherein the first and second shoulder portions each comprise at least two different geometries; and first and second electrodes extending inwardly from the first and second legs to respective first and second electrode tips spaced apart from one another by an arc gap within the ceramic arc envelope;

wherein a tip-to-neck distance and a tip-to-wall distance are configured to maintain stress and temperature levels below threshold levels in the high intensity discharge lamp, the tip-to-neck distance extends from the first and second electrode tips to the respective first and second necks, and the tip-to-wall distance extends from the first and second electrode tips to respective first and second interior wall surfaces of the ceramic arc envelope in perpendicular directions relative to a longitudinal axis of the high intensity discharge lamp.

2. The system of claim 1, wherein the first and second shoulder portions each comprise the one or more cup-shaped geometries.

3. The system of claim 1, wherein the first and second shoulder portions each comprise the one or more curved funnel-shaped geometries.

4. The system of claim 1, wherein the first and second shoulder portions each comprise the one or more conical-shaped geometries.

5. The system of claim 1, comprising a dose material sealed within the ceramic arc envelope, wherein the dose material comprises a high pressure inert gas and one or more metal halides without any mercury.

6. The system of claim 1, wherein the first shoulder portion comprises a first geometry, the second shoulder portion comprises a second geometry, and the first and second geometries are different from one another.

7. The system of claim 1, comprising a dose material sealed within the ceramic arc envelope, wherein the dose material comprises a high pressure inert gas, mercury, and a metal halide.

8. The system of claim 1, wherein the first and second shoulder portions each comprise the one or more cup-shaped geometries and the one or more curved funnel-shaped geometries.

9. The system of claim 1, wherein the ceramic arc envelope and the first and second legs are a single ceramic structure without any intermediate seal interfaces.

10. The system of claim 1, wherein the first and second electrodes each comprises a coil disposed about a shank, and the coil comprises molybdenum, rhenium, or a molybdenum-rhenium alloy.

11. The system of claim 1, wherein the tip-to-neck distance is between about 0.25 mm and 1.55 mm, and the tip-to-wall distance is between about 0.13 mm and half of an internal diameter of the ceramic arc envelope.

12. The system of claim 11, wherein the internal diameter is between about 1.6 mm and 4 mm.

13. The system of claim 12, wherein the arc gap is between about 2 mm and 8 mm.

14. The system of claim 13, wherein a wall thickness of the ceramic arc envelope is between about 0.3 mm and 1.2 mm.

15. The system of claim 14, wherein a shank diameter of each electrode is between about 0.25 mm and 0.4 mm.

16. A system, comprising:

a high intensity discharge lamp, comprising:

a ceramic arc envelope having opposite first and second annular shoulders leading to opposite first and second annular necks, respectively, wherein the first and second annular shoulders have respective first and second variable diameters that increases toward a hollow central region of the ceramic arc envelope;

a first electrode extending through the first annular neck and the first annular shoulder to a first electrode tip in the ceramic arc envelope, wherein a first tip-to-neck distance extends between the first electrode tip and the first annular neck, and a first tip-to-wall distance extends in a first perpendicular direction between the first electrode tip and a first interior wall surface of the ceramic arc envelope;

a second electrode extending through the second annular neck and the second annular shoulder to a second electrode tip in the ceramic arc envelope, wherein a second tip-to-neck distance extends between the second electrode tip and the second annular neck, and a second tip-to-wall distance extends in a second perpendicular direction between the second electrode tip and a second interior wall surface of the ceramic arc envelope;

wherein the first and second tip-to-neck distances are between about 0.25 mm and 1.55 mm, and the first and second tip-to-wall distances are between about 0.13 mm and half of an internal diameter of the ceramic arc envelope.

17. The system of claim 16, wherein the first and second annular shoulders each have a cup-shaped geometry, or a curved funnel-shaped geometry, or a conical-shaped geometry.

18. The system of claim 17, wherein the first and second annular shoulders each comprise at least two different geometries.

19. The system of claim 17, wherein the first annular shoulder comprises a first geometry, the second annular shoulder comprises a second geometry, and the first and second geometries are different from one another.

20. The system of claim 16, wherein the internal diameter is between about 1.6 mm and 4 mm.

21. The system of claim 16, wherein an arc gap between the first and second electrode tips is between about 2 mm and 8 mm.

22. The system of claim 16, wherein a wall thickness of the ceramic arc envelope is between about 0.3 mm and 1.2 mm.

23. The system of claim 16, wherein the first and second tip-to-neck distances and the first and second tip-to-wall distances are configured to balance an inversely proportional relationship between maximum stress and maximum temperature within the ceramic arc envelope.

24. A system, comprising:

a high intensity discharge lamp comprising an arc envelope having opposite shoulders leading to opposite necks, opposite electrode shanks that extend through the opposite necks, and opposite electrode tips are coupled to the opposite electrode shanks, wherein:

an arc gap distance separating the electrode tips is between about 2 mm and 8 mm;

a tip-to-neck distance between each electrode tip and respective neck of the arc envelope is between about 0.25 mm and 1.55 mm;

a tip-to-wall distance in a perpendicular direction between each electrode tip and an interior wall of the arc envelope is between about 0.13 mm and half of an internal diameter of the arc envelope;

the internal diameter of the arc envelope is between about 1.6 mm and 4 mm;

a wall thickness of the arc envelope is between about 0.3 mm and 1.2 mm; and a shank diameter of each electrode shank is between about 0.25 mm and 0.4 mm.

25. The system of claim 24, wherein the opposite shoulders each comprise at least two different geometries.

26. The system of claim 24, comprising an arc straightening mechanism if the internal diameter is greater than about 2.5 mm.

27. The system of claim 24, wherein the opposite shoulders have diameters that progressively increase from the opposite necks toward a central region between the opposite shoulders.

28. The system of claim 24, wherein the arc gap distance is greater than or equal to a central distance between the opposite shoulders, and the arc gap distance is less than an internal bulb length between the opposite necks.

29. The system of claim 24, wherein the wall thickness of the arc envelope is between about 0.3 mm and 0.8 mm if the internal diameter is between about 2.5 mm and 4 mm, wherein the wall thickness of the arc envelope is between about 0.6 mm and 1.2 mm if the internal diameter is between about 1.6 mm and 2.5 mm.

30. A system, comprising:

a high intensity discharge lamp, comprising:

a ceramic arc envelope comprising a central portion and first and second shoulder portions disposed about the central portion, wherein the first and second shoulder portions each have a progressively varying diameter;

first and second legs coupled to the first and second shoulder portions at first and second necks, respectively, wherein the first and second shoulder portions each comprise one or more cup-shaped geometries, or one or more curved funnel-shaped geometries, or one or more conical-shaped geometries, wherein the first shoulder portion comprises a first geometry, the second shoulder portion comprises a second geometry, and the first and second geometries are different from one another; and first and second electrodes extending inwardly from the first and second legs to respective first and second electrode tips spaced apart from one another by an arc gap within the ceramic arc envelope;

wherein a tip-to-neck distance and a tip-to-wall distance are selected to reduce the possibility of stress and temperature exceeding levels in the high intensity discharge lamp, the tip-to-neck distance extends from the first and second electrode tips to the respective first and second necks, and the tip-to-wall distance extends from the first and second electrode tips to respective first and second interior wall surfaces of the ceramic arc envelope in perpendicular directions relative to a longitudinal axis of the high intensity discharge lamp.

* * * * *